US008711072B2

(12) United States Patent
Warmuth et al.

(10) Patent No.: US 8,711,072 B2
(45) Date of Patent: Apr. 29, 2014

(54) MOTION BLUR REDUCTION FOR LCD VIDEO/GRAPHICS PROCESSORS

(75) Inventors: Otto Leo Warmuth, Neu Wulmstorf (DE); Robert Tolkiehn, Hamburg (DE); Roel Van Woudenberg, Eindhoven (NL)

(73) Assignee: Entropic Communications, Inc., San Diego, CA (US)

( * ) Notice: Subject to any disclaimer, the term of this patent is extended or adjusted under 35 U.S.C. 154(b) by 1306 days.

(21) Appl. No.: 11/574,344

(22) PCT Filed: Aug. 30, 2005

(86) PCT No.: PCT/IB2005/052837

§ 371 (c)(1), (2), (4) Date: Aug. 15, 2007

(87) PCT Pub. No.: WO2006/025021

PCT Pub. Date: Mar. 9, 2006

(65) Prior Publication Data

US 2008/0279470 A1 Nov. 13, 2008

(30) Foreign Application Priority Data

Sep. 3, 2004 (EP) ..... 04104268

(51) Int. Cl.
*G09G 3/36* (2006.01)
*G09G 5/00* (2006.01)

(52) U.S. Cl.
USPC ..... 345/88; 345/690

(58) Field of Classification Search
USPC ..... 345/87–90, 690, 204; 348/663–670, 348/673, 791, 792
See application file for complete search history.

(56) References Cited

U.S. PATENT DOCUMENTS

| | | | | |
|---|---|---|---|---|
| 6,493,041 | B1 | 12/2002 | Hanko et al. | |
| 6,774,916 | B2 * | 8/2004 | Pettitt et al. | 345/691 |
| 7,061,548 | B2 * | 6/2006 | Piepers | 348/624 |
| 7,106,286 | B2 * | 9/2006 | Baba et al. | 345/88 |
| 7,271,850 | B2 * | 9/2007 | Chao | 348/609 |
| 2002/0030652 | A1 | 3/2002 | Shibata et al. | |
| 2003/0063221 | A1 * | 4/2003 | Stessen et al. | 348/678 |
| 2003/0174110 | A1 | 9/2003 | Baba et al. | |

(Continued)

FOREIGN PATENT DOCUMENTS

| | | |
|---|---|---|
| JP | 200291390 | 3/2002 |
| JP | 2002519949 | 7/2002 |
| JP | 20044829 | 1/2004 |

*Primary Examiner* — Kevin M Nguyen
(74) *Attorney, Agent, or Firm* — Richard Bachand; Duane Morris LLP

(57) ABSTRACT

The present invention relates to a method and a system of reducing motion blur in a liquid crystal cell. A basic idea of the invention is to process, in an LCD system, a luminance component (Y) of a picture frame to provide motion blur reduction, wherein overdrive is applied to the luminance component only. First, a luminance component related to a first picture frame is stored. Thereafter, a luminance component of a subsequent picture frame is acquired. To reduce motion blur in the LCD, a modified luminance component (Y') is created based on a difference between the value of the luminance component of the subsequent frame and the value of the luminance component related to the first frame. Hence, based on the value of the difference in the luminance components, and color components (U, V) of the subsequent picture frame, a drive voltage is applied to the LC cell.

22 Claims, 6 Drawing Sheets

(56) References Cited

U.S. PATENT DOCUMENTS

2003/0210217 A1 11/2003 Lee
2004/0012551 A1 1/2004 Ishii
2005/0057471 A1* 3/2005 Lu et al. ..... 345/89
2005/0083353 A1* 4/2005 Maruyama et al. ..... 345/690
2005/0140631 A1* 6/2005 Oh et al. ..... 345/89
2005/0275645 A1* 12/2005 Shen et al. ..... 345/204

* cited by examiner

MOTION BLUR REDUCTION FOR LCD VIDEO/GRAPHICS PROCESSORS

The present invention relates to a method and a system of reducing motion blur in a liquid crystal cell.

Overdrive is a technique employed to improve response speed in a liquid crystal display (LCD). In this technique, LCD drive voltage is increased to speed up transition of a liquid crystal cell. Current state-of-the art LCD panels typically require two to several tens of frame periods to fully change from one gray level to another without overdrive, while they can speed up to a response period of one frame when overdrive is applied. Non-instant transition results in blurring of moving objects. Speeding up the LC cell transition thus results in less motion blur in the LCD. As the transition speed between intermediate gray scale levels is dependent on both start gray level and desired gray level, overdrive drive levels are obtained from the pixel value of the previous frame and the desired pixel value. As the required overdrive level usually does not depend linearly on these two gray levels, one usually retrieves the overdrive level from a lookup table (LUT). This dependence on historical pixel values requires a frame memory.

Current methods use a frame memory that stores all sub pixel values (i.e. each of the three components red (R), green (G) and blue (B), the display primaries) for all pixels of the display. This results in a high-cost display. For example, for an 8-bit 16:9 WXGA display, 3×1366×768=3.15 million bytes of memory are required. Moreover, due to speed requirements, a relatively high memory bandwidth is needed. Furthermore, processing is generally performed towards the end of the video/display processing chain, i.e. at the interface to the LCD column drivers, where the exact values of brightness/drive levels are available. In LCD's, due to the structure of the display hardware architecture, interfacing to a memory is typically difficult at this position in the LCD processing chain.

US patent application publication no. 2003/0174110 discloses a liquid crystal displaying method which multiplies a difference value of luminance information and a difference value of color-difference information each by an emphasis coefficient. The luminance information (Y) in which the input image information has been delayed for one frame period, and the color-difference information (U, V) in which the input image information has been delayed for one frame period, is added to the difference value of the luminance information that is multiplied by the emphasis coefficient, and to the difference value of the color-difference information that is multiplied by the emphasis coefficient, respectively, to obtain emphasized image information.

A problem in US patent application publication no. 2003/0174110 is that a relatively large storage area is required for storing image information, due to the fact that all three signal components (Y, U and V) in the YUV color space are employed in the disclosed displaying method. In practice, the cost of a display system employing the method will be a function of the size of the storage area for storing the image information, i.e. the signal components. Consequently, as the size of the storage area increases, so will the cost of the system.

It is an object of the present invention to solve the above given problems and to provide motion blur reduction at a low cost.

A basic idea of the invention is to process, in an LCD system, a luminance component (Y) of a picture frame to provide motion blur reduction, wherein overdrive is applied to the luminance component only. First, a luminance component related to a first picture frame is stored in a frame memory. Thereafter, a luminance component of a subsequent picture frame is acquired. To reduce motion blur in the LCD, LC cell transition is increased. Since the speed of transition from one gray scale level to another is dependent on both the gray level of a current frame and the gray level of a desired frame that is to be displayed, a modified luminance component (Y') is created. This modified luminance component is based on a difference between the value of the luminance component, i.e. a luminance value, of the subsequent frame and the value of the luminance component related to the first frame. Hence, based on the value of the difference in the luminance components, i.e. on the value of the modified luminance component, and color components (U, V) of the subsequent picture frame, a drive voltage is applied to the LC cell, wherein the response of the liquid crystal cell is increased for the subsequent picture frame. Thus, an overdrive effect is provided, based on storage and processing of luminance components (Y).

Since the human visual system is sensitive to luminance errors, but less sensitive to small color errors, it is important that a correct luminance is provided. To achieve the correct luminance, transition speed from one luminance level to another in an LC cell is increased. When overdrive, i.e. a transition speed increase by means of application of an excess drive voltage, is applied to the luminance component (Y) only, the storing area for holding YUV signal components is only one third of the storage area that would be required to hold the signal components if overdrive was to be applied to the luminance component as well as the color components (U, V), as is done in the prior art. Consequently, a less expensive display may be provided.

According to embodiments of the present invention, the modified luminance component is created by assigning a value to the modified luminance component, which value is based on a function that relates to said difference. Preferably, the modified luminance component is created by assigning a value to the modified luminance component, which value is based on said difference multiplied by an overdrive factor. A number of different algorithms exists for creating the modified luminance component. It is, for example, possible that the value of the modified luminance component is created by further adding the value of the luminance component of said first picture frame Alternatively, it is possible that the value of the modified luminance component is created by further adding the value of the luminance component of said subsequent picture frame The overdrive factor is preferably a variable factor that depends on the magnitude of said difference or on one of the luminance components. This has the effect that the overdrive function may be different for different modified luminance components, and hence the overdrive factor is not a constant. The overdrive factor for each specific modified luminance component can be obtained from a predetermined look-up table.

According to another embodiment of the present invention, overdrive on the luminance component is applied early in the LCD processing chain. This may preferably be performed at a block in the processing chain where the value of the luminance component of the previous frame is already available, for example at a temporal noise reduction (TNR) block, a motion detection block or the like, where previous and current luminance values are compared. Since a motion blur reduction block also performs processing by employing a current and a previous pixel value, as described hereinabove, memory access can be shared with the temporal noise reduction block (or the motion detection block) and the motion blur reduction block, which leaves more bandwidth available for other processing blocks.

According to yet another embodiment of the present invention, a threshold value for motion blur detection may be set for determining if overdrive is to be applied to an LC cell. If the value of the difference between the value of the luminance component of a current frame and the value of the luminance component of a previous frame lies below the threshold value, then no excess drive voltage is applied to the LC cell. If the value of the difference exceeds the threshold value, overdrive is applied to the LC cell.

According to yet another embodiment of the present invention, a threshold value may be set for determining if temporal noise reduction is to be effected. If the value of the difference between the value of the luminance component of a current frame and the value of the luminance component of a previous frame lies below the threshold value for temporal noise reduction, then noise reduction is performed on the difference value, e.g. by low-pass filtering. If the value of the difference exceeds the threshold value, no noise reduction is undertaken.

According to still another embodiment of the present invention, the threshold value for motion blur reduction is set to be equal to the threshold value for temporal noise reduction. Thereby the motion blur reduction processing and the temporal noise reduction processing may be combined in one single algorithm. This is particularly advantageous when the TNR is dynamic, i.e. when the noise threshold depends on image content and/or spatial surroundings of the pixel. This allows use of a very low motion blur reduction threshold (overdrive threshold) when the image has little noise, e.g. in images with a moving gray shade (thus having a slowly changing luminance). Hence, small luminance differences are overdriven to reach the desired luminance value instead of being qualified as noise.

According to still another embodiment of the present invention, the luminance component is stored with a spatial resolution that is lower than full panel resolution in the frame memory, preferably at video source resolution. Since the frame memory can be smaller at reduced spatial resolution, it is advantageous to store the luminance component with video source resolution compared to storing it at LCD panel resolution. For example, when receiving an interlaced PAL signal of 720×576/2 pixels, these pixels can be stored instead of 1366×768, which are the number of pixels at panel resolution. This has the consequence that the size of the frame memory of luminance components may be (720×576/2)/(1366×768) =20% of the size that would have been required at panel resolution. For a de-interlaced PAL signal of 720×576 pixels, as e.g. delivered by high-quality DVD players, the frame memory is still reduced to 40%. What must be compensated due to slow LC response is the incorrect RGB value of an object in the image. Whether this object covers a pixel or a plurality of pixels does not make much difference. Scaling from video source resolution to panel resolution will nevertheless "smear" any original object over a number of pixels.

According to another embodiment of the present invention, implementation in an LCD-TV system with scanning backlight is advantageous. In an LCD-TV system with scanning backlight, the backlight is operated in segments. These segments are not activated for a full frame period, but only for a fraction, e.g. 25%, of the full frame period. This reduces sample-and-hold time from the full frame period to the fraction of the full period, and thus reduces motion blur. However, slower response cause ghost images, as backlight flashes, i.e. backlight activation/deactivation, "sample" LC response. Any suppression of ghost signal amplitude is then very important. This is another type of perceived image deterioration compared to motion blur (although it is caused by the same phenomena—slow LC response) that requires overdrive, as sufficiently fast LC response time is essential for scanning backlight operation without artifacts.

Note that the present invention also can be applied to displays that employ color spaces other than the RGB color space, for example color spaces based on the RGB color space. Currently, there is research made on displays that contain more primary colors then just R, G and B, e.g. the colors of white and yellow. Displays that employ these "extended" color spaces lies within the scope of the present invention, as defined by the attached claims.

Further features of, and advantages with, the present invention will become apparent when studying the appended claims and the following description. Those skilled in the art realize that different features of the present invention can be combined to create embodiments other than those described in the following.

Preferred embodiments of the present invention will be described in more detail with reference made to the accompanying drawings, in which.

Figure 1:
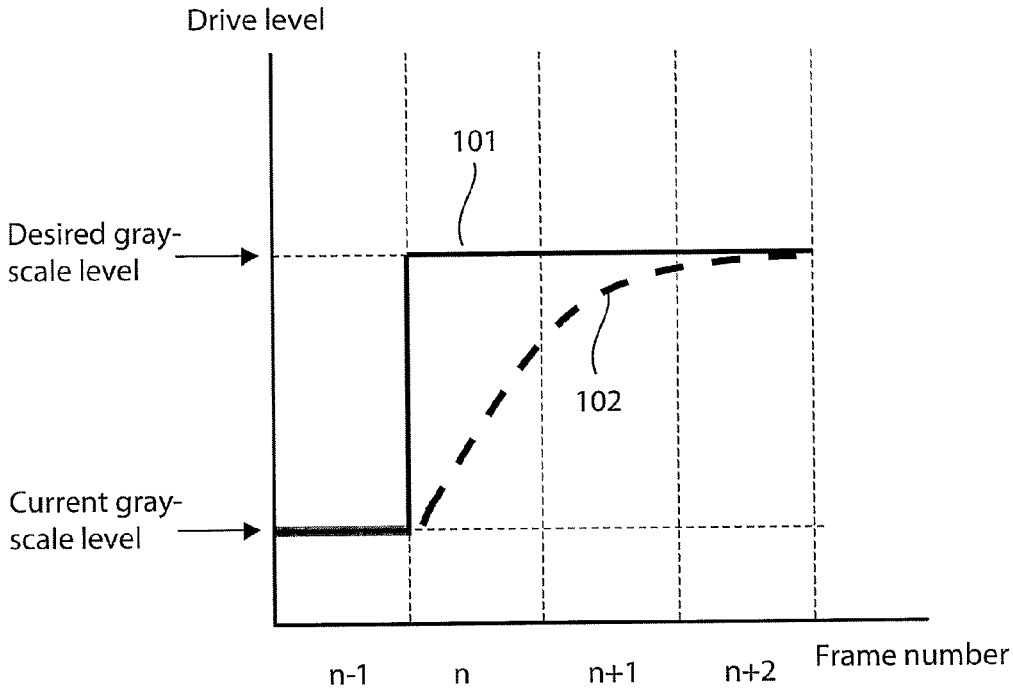
FIG. 1 shows the response of an LC cell to which no overdrive voltage is applied.

FIG. 1 shows the response of an LC cell to which no overdrive voltage is applied. An LCD drive voltage 101 is applied to an LC cell to make the cell change from a current gray-scale level to a desired gray-scale level. As can be seen from the exemplifying illustration of FIG. 1, LC response 102 speed is rather slow, and the desired gray-scale level is not reached until the end of the period of frame n+2. Generally, in LCD display systems, this delay is highly undesirable.

Figure 2:
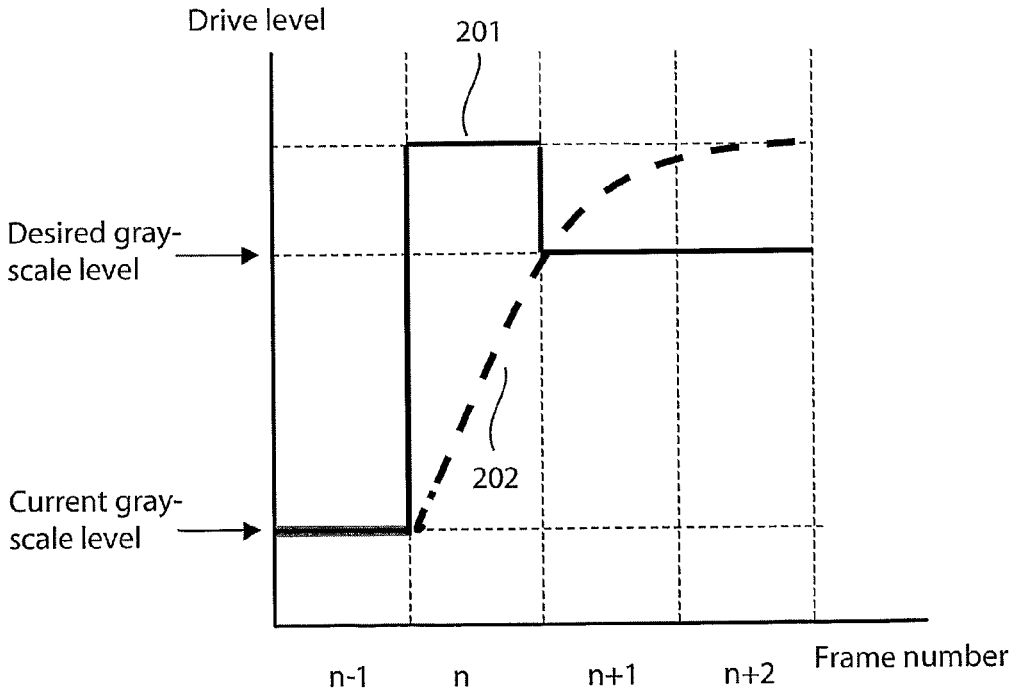
FIG. 2 shows the response of an LC cell to which an overdrive voltage is applied.

FIG. 2 shows the response of an LC cell to which an overdrive voltage is applied. An LCD drive voltage 101 is applied to an LC cell to make the cell change from a current gray-scale level to a desired gray-scale level. During the frame period associated with frame n, an overdrive voltage is applied. As can be seen from the exemplifying illustration of FIG. 2, LC response 202 speed is increased, and the desired gray-scale level is reached at the transition from frame n to frame n+1, i.e. within one frame period, which is preferred.

Figure 3:
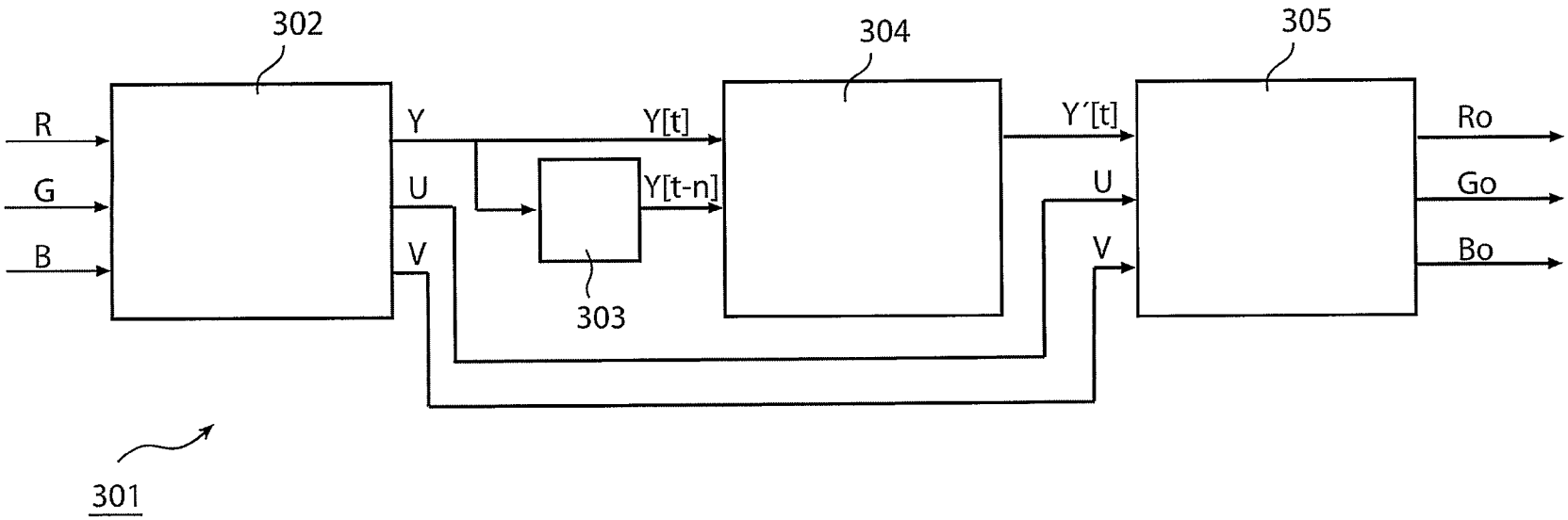
FIG. 3 shows a principal block scheme of an architecture for increasing response speed of LC cells in an LCD system, in accordance with an embodiment of the present invention.

FIG. 3 shows a principal block scheme of an architecture 301 for increasing the response speed of LC cells in an LCD system in accordance with an embodiment of the present invention. RGB color components of a first picture frame are supplied to a converter 302 from RGB color space to YUV color space. The luminance component Y[t−n] of the first frame is stored in a frame memory 303, where n denotes frame number. If the difference in frames between a first frame and a subsequent frame is one, then n=1, if the difference is two frames, then n=2, etc. Hereinafter, for illustrative purposes, it is assumed that the difference is one frame, hence n=1. For European (PAL) TV, the following relations apply for the RGB to YUV conversion:

$$Y=0.299*R+0.587*G+0.114*B,$$

$$U=-0.147*R-0.289*G+0.436*B,$$

$$V=0.615*R-0.515*G-0.100*B,$$ and ranges are rescaled to 0-255.

Note that this particular conversion is merely exemplifying, and conversions for other color systems, such as HDTV or sRGB, are obvious and trivial for the skilled person.

Thereafter, the luminance component Y[t] of a subsequent picture frame is acquired. As the required overdrive level to be applied to the LC cell usually does not depend linearly on the first gray level and the subsequent desired gray level, one usually retrieves an overdrive factor α (and possibly a second overdrive factor β) used to provide the overdrive level from a lookup table (LUT) 304, based on a difference between the first gray level and the subsequent desired gray level. Hence, a modified luminance component Y'[t] is created, the value of which modified component is based on the difference between the first luminance component Y[t−n] and the subsequent desired luminance component Y[t]. This modified luminance component Y'[t] may be created in a number of different manners, as illustrated by equations (1)-(3) in the following:

$$Y'[t]=Y[t-n]+\alpha(Y[t]-Y[t-n]) \text{ for } \alpha\geq 1; \quad (1)$$

$$Y'[t]=Y[t]+\alpha(Y[t]-Y[t-n]) \text{ for } 0<\alpha<1; \quad (2)$$

Higher order equations may also be used:

$$Y'[t]=Y[t]+\alpha(Y[t]-Y[t-n])+\beta(Y[t-n]/Y\max)(Y[t]-Y[t-n]) \quad (3),$$

where α and β are approximately 1/16 and Ymax=255 for 8 bits. Hence, the modified luminance component Y'[t] is in accordance with this specific embodiment of the present invention based on the difference between the first luminance component Y[t−n] and the subsequent desired luminance component Y[t], wherein the difference is multiplied with a variable overdrive factor α.

After having created the modified luminance component Y'[t], it is supplied to an YUV to RGB converter 305. Again, for European (PAL) TV, the following relations apply:

$$Ro=Y'+0.000*U+1.140*V,$$

$$Go=Y'-0.396*U-0.581*V,$$

$$Bo=Y'+2.029*U+0.000*V.$$

Finally, the overdrive values, Ro, Go and Bo are employed to provide an overdrive voltage to the LC cell. Note that the modified luminance component Y'[t] may be further processed before being converted to RGB. For example, it can be spatially scaled to another resolution.

Figure 4:
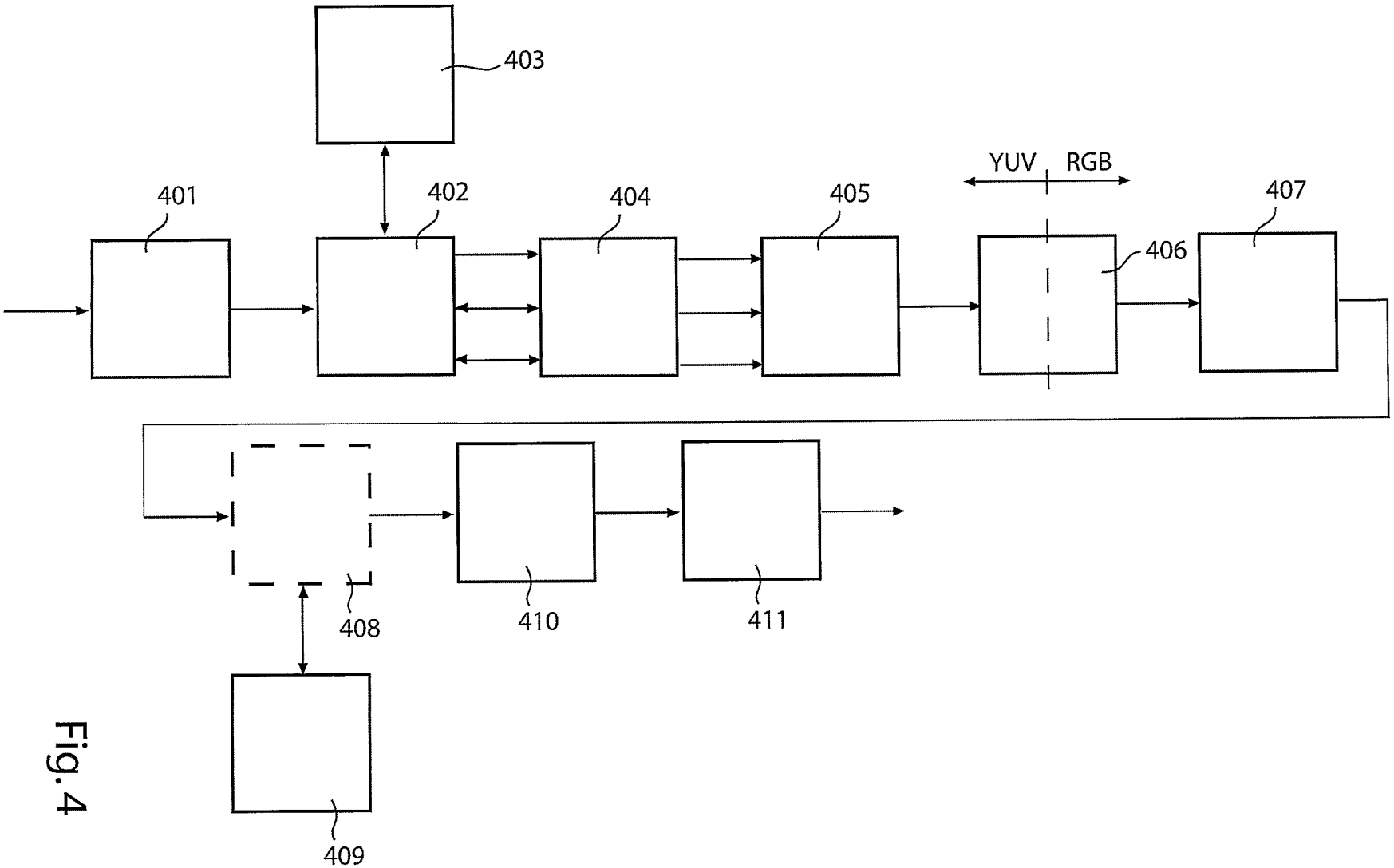
FIG. 4 shows an exemplifying block scheme of a typical LCD system processing chain.

FIG. 4 shows an exemplifying block scheme of a typical LCD system processing chain. Included components will not be described in detail, but will only serve as to set forth the principles of the present invention. The exemplifying processing chain comprises a video input block 401, a memory interface 402, a first memory 403, a noise reduction block 404, a scaling block 405, a YUV to RGB converter 406, a gamma correction block 407, an overdrive block 408 (which is indicated for clarity purposes with dashed lines), a second frame memory 409, a panel interface 410 and display drivers 411. Since the overdrive is applied relatively late in the prior art processing chain illustrated in FIG. 4, the data stored in the frame memory 409 is stored with full panel resolution, which requires a relatively large amount of memory.

Figure 5:
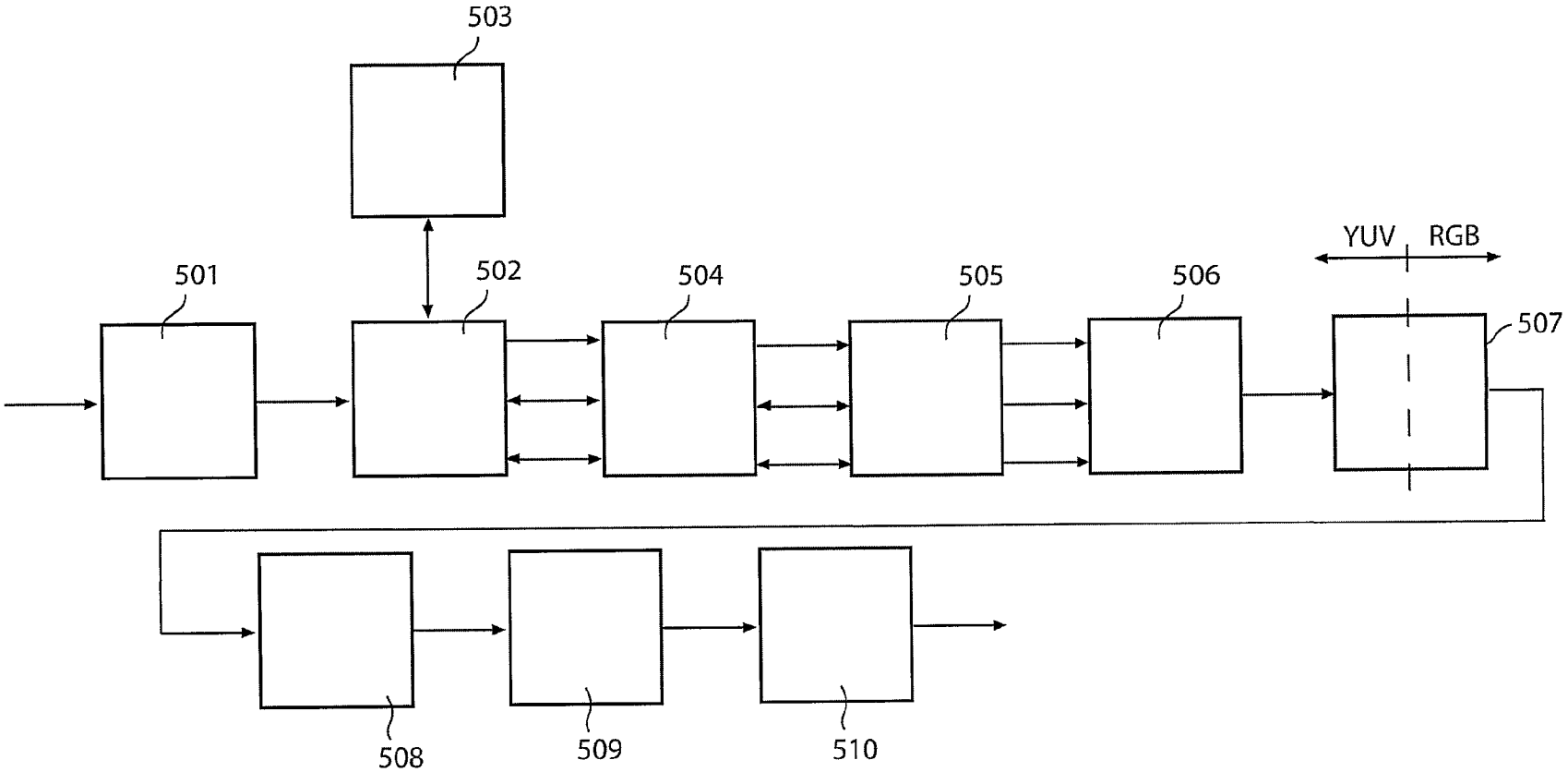
FIG. 5 shows an exemplifying block scheme of an LCD system processing chain in accordance with an embodiment of the present invention.

FIG. 5 shows an exemplifying block scheme of an LCD system processing chain in accordance with an embodiment of the present invention. The processing chain comprises a video input block 501, a memory interface 502, a frame memory 503, a noise reduction block 504, an overdrive block 505, a scaling block 506, a YUV to RGB converter 507, a gamma correction block 508, a panel interface 509 and display drivers 510. Since the overdrive is applied earlier in the processing chain of the present invention illustrated in FIG. 5, as compared to the prior art processing chain shown in FIG. 4, the data stored in the frame memory 503 is stored with video source resolution, which requires a smaller amount of memory, as has been shown previously.

Figure 6:
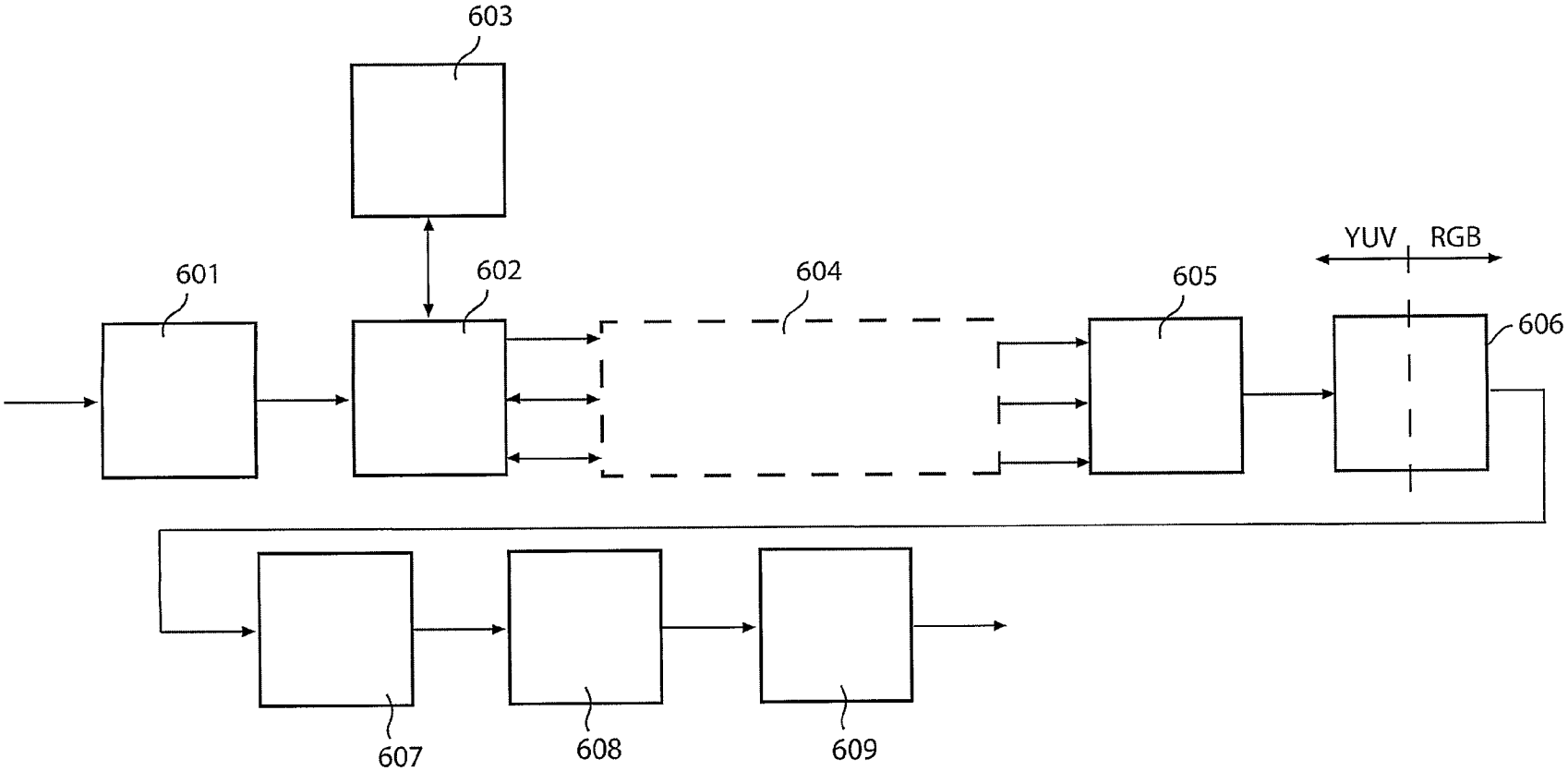
FIG. 6 shows an exemplifying block scheme of an LCD system processing chain in accordance with another embodiment of the present invention.

FIG. 6 shows an exemplifying block scheme of an LCD system processing chain in accordance with another embodiment of the present invention. The processing chain comprises a video input block 601, a memory interface 602, a frame memory 603, a combined noise reduction and overdrive block 604, a scaling block 605, a YUV to RGB converter 606, a gamma correction block 607, a panel interface 608 and display drivers 609. As previously discussed, the motion blur reduction processing and the temporal noise reduction processing may be combined in one single algorithm (block) by setting the threshold value for motion blur reduction equal to the threshold value for temporal noise reduction. This is particularly advantageous when the TNR is dynamic, i.e. when the noise threshold depends on image content and/or spatial surroundings of the pixel. This allows use of a very low motion blur reduction threshold (overdrive threshold) when the image has little noise, e.g. in images with a moving gray shade (thus having a slowly changing luminance). Hence, small luminance differences are overdriven to reach the desired luminance value instead of being qualified as noise. Note that the overdrive may be combined with any other appropriate block in the processing chain where the value of the luminance component of the previous frame is already available, for example at a motion detection block (not shown) or the like, where previous and current luminance values are compared.

Figure 7:
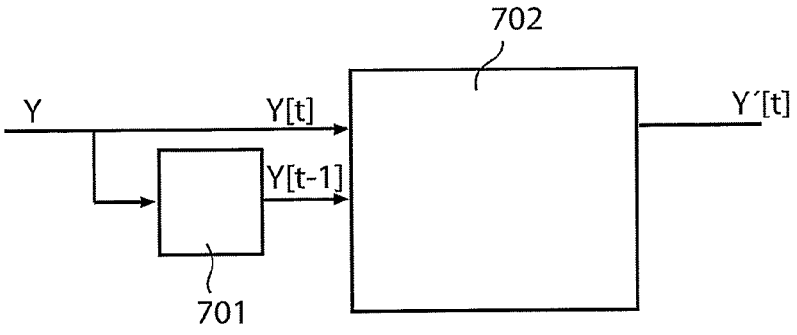
FIG. 7 shows an exemplifying feed-forward method of providing overdrive to an LC cell in accordance with an embodiment of the present invention.

FIG. 7-10 show exemplifying methods of providing overdrive in accordance with embodiments of the present invention. FIG. 7 shows a feed-forward method used in the architecture described in connection to FIG. 3. The luminance component Y[t−1] of a first frame is stored in a frame memory 701. Thereafter, the luminance component Y[t] of a subsequent picture frame is acquired. As the required overdrive voltage to be applied to the LC cell usually does not depend linearly on the first gray level and the subsequent desired gray level, one usually retrieves a variable overdrive factor α used to provide the overdrive voltage from a lookup table (LUT) 702, based on a difference between the first gray level and the subsequent desired gray level. Hence, a modified luminance component Y'[t] is created, the value of which modified component is based on the difference between the first luminance component Y[t−1] and the subsequent desired luminance component Y[t]. The overdrive voltage that is applied to the LC cell is based on the modified luminance component Y'.

Figure 8:
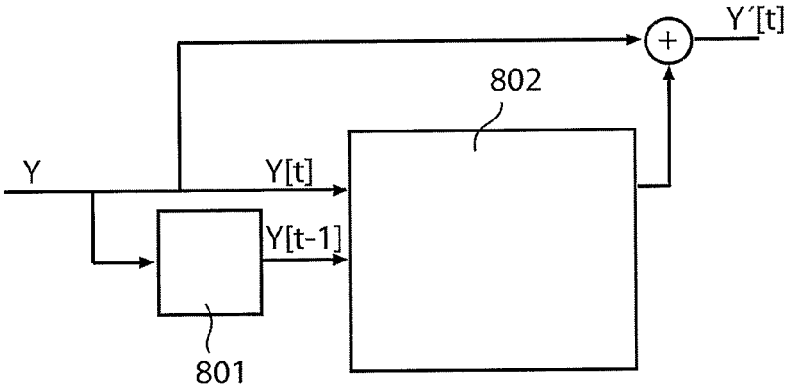
FIG. 8 shows another exemplifying feed-forward method of providing overdrive to an LC cell in accordance with an embodiment of the present invention.

FIG. 8 shows another feed-forward overdrive method. The luminance component Y[t−1] of a first frame is stored in a frame memory 801. Thereafter, the luminance component Y[t] of a subsequent picture frame is acquired. A variable overdrive factor α used to provide the overdrive voltage is acquired from a lookup table (LUT) 802, based on a difference between the first gray level and the subsequent desired gray level. In this exemplifying method, a modified luminance component Y' is created, the value of which modified component is based on the difference between the first luminance component Y[t−1] and the subsequent desired luminance component Y[t], wherein the difference is added to the value of the subsequent luminance component Y[t]. The modified luminance component Y' is then used to apply an overdrive voltage to the LC cell.

Figure 9:
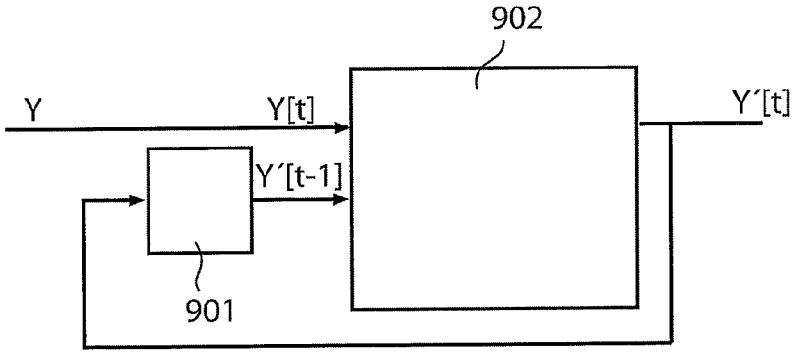
FIG. 9 shows an exemplifying feedback method of providing overdrive to an LC cell in accordance with an embodiment of the present invention.

FIG. 9 shows a feedback overdrive method. The luminance component Y[t] of a desired picture frame is acquired. Thereafter, a variable overdrive factor α used to provide the overdrive voltage is fetched from a lookup table (LUT) 902, based on a difference between the desired gray level and a previously modified gray level, which previously modified gray level is stored in a frame memory 901. Hence, a modified luminance component Y' is created, the value of which modified component is based on the difference between the desired luminance component Y[t] and the previously modified luminance component Y'[t−1]. The modified luminance component Y' is then used to provide an overdrive voltage to the LC cell.

Figure 10:
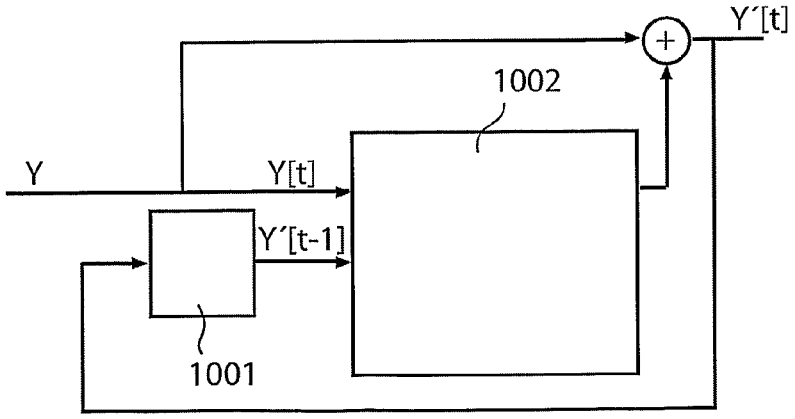
FIG. 10 shows another exemplifying feedback method of providing overdrive to an LC cell in accordance with an embodiment of the present invention.

FIG. 10 shows another feedback overdrive method. The luminance component Y[t] of a desired picture frame is acquired. Thereafter, an overdrive factor α used to provide the overdrive voltage is fetched from a lookup table (LUT) 1002, based on a difference between the desired gray level and a previously modified gray level, which previously modified gray level is stored in a frame memory 1001. Hence, a modified luminance component Y' is created, the value of which modified component is based on the difference between the desired luminance component Y[t] and the previously modified luminance component Y'[t−1], wherein the difference is added to the value of the desired luminance component Y[t]. The modified luminance component Y' is then used to provide an overdrive voltage to the LC cell.

As can be seen in FIG. 7-10, no overdrive factor α is used to provide an overdrive voltage to the LC cell, but the LUT directly returns the modified luminance component on the basis of the luminance components input to the LUT. It is clearly understood that both approaches of applying an overdrive voltage is possible, i.e. employing the overdrive factor α or directly obtaining the modified luminance component, as set out in the appended claims.

Even though the invention has been described with reference to specific exemplifying embodiments thereof, many different alterations, modifications and the like will become apparent for those skilled in the art. The described embodiments are therefore not intended to limit the scope of the invention, as defined by the appended claims.

The invention claimed is:

1. A method of reducing motion blur in a liquid crystal cell, the method comprising the steps of:

converting a previous picture frame from an RGB color space into a YUV color space;

storing a luminance component in the YUV color space related to the previous picture frame;

converting a current picture frame from an RGB color space into the YUV color space;

determining an overdrive factor based on a difference between a luminance component in the current picture frame in the YUV color space and the stored luminance component;

creating a modified luminance component by applying the overdrive factor only to the luminance component of the current picture frame in the YUV color space; and converting the modified luminance component and color components of the current picture frame back into an RGB color space for display in the liquid crystal cell;

thereby increasing the transition speed from one luminance level to another.

2. The method according to claim 1, wherein said creating the modified luminance component comprises assigning a value to the modified luminance component based on a function that relates to said difference.

3. The method according to claim 2, wherein said creating the modified luminance component comprises assigning a value to the modified luminance component based on said difference multiplied by the overdrive factor.

4. The method according to claim 3, wherein said creating the modified luminance component further comprises adding the value of the luminance component related to said previous picture frame.

5. The method according to claim 3, wherein said creating modified luminance component further comprises adding the value of the luminance component of said current picture frame.

6. The method according to claim 3, wherein the overdrive factor is a variable factor that depends on a magnitude of said difference.

7. The method according to claim 3, wherein the overdrive factor is a variable factor that depends on a magnitude of a luminance component.

8. The method according to claim 6, wherein the overdrive factor is obtained from a look-up table.

9. The method according to claim 2, wherein the modified luminance component is created by assigning a value to the modified luminance component, which value is directly obtained from a predetermined look-up table.

10. The method according to claim 1, wherein the luminance component of each picture frame is stored in a frame memory.

11. The method according to claim 10, wherein motion blur reduction processing shares access to the frame memory with any other video processing that acquires a previous and a current luminance component.

12. The method according to claim 11, wherein said any other video processing that acquires a previous and a current luminance component comprises temporal noise reduction processing.

13. The method according to claim 11, wherein said any other video processing that acquires a previous and a current luminance component comprises motion detection processing.

14. The method according to claim 1, further comprising the step of:

setting a threshold value for motion blur reduction, wherein a drive voltage is applied to the liquid crystal cell if the value of said difference exceeds the threshold value.

15. The method according to claim 1, further comprising the step of:

setting a threshold value for temporal noise reduction wherein noise reduction is performed on said difference if a value of said difference is smaller than a temporal noise reduction threshold value.

16. The method according to claim 14, wherein the threshold value for motion blur reduction is set equal to a threshold value for temporal noise reduction.

17. The method according to claim 1, wherein the luminance component is stored with a resolution that is lower than a full panel resolution.

18. The method according to claim 1, wherein the stored luminance component comprises a luminance component of the previous picture frame.

19. The method according to claim 1, wherein the stored luminance component comprises a modified luminance component of the previous picture frame.

20. A computer program product comprising a non-transitory computer readable storage medium that stores computer-executable instructions that implement a method of reducing motion blur in a liquid crystal cell, the method comprising the steps of:

converting a previous picture frame from an RGB color space into a YUV color space;

storing a luminance component in the YUV color space related to the previous picture frame;

converting a current picture frame from an RGB color space into the YUV color space;

determining an overdrive factor based on a difference between a luminance component in the current picture frame in the YUV color space and the stored luminance component;

creating a modified luminance component by applying the overdrive factor only to the luminance component of the current picture frame in the YUV color space; and converting the modified luminance component and color components of the current picture frame back into an RGB color space for display in the liquid crystal cell;

thereby increasing the transition speed from one luminance level to another.

21. A system for reducing motion blur in a liquid crystal cell, the system comprising:

means for converting a previous picture frame from an RGB color space into a YUV color space;

means for storing a luminance component in the YUV color space related to a the previous picture frame;

means for converting a current picture frame from an RGB color space into the YUV color space;

means for determining an overdrive factor based on a difference between a luminance component in said current picture frame in the YUV color space and the stored luminance component;

means for creating a modified luminance component by applying a drive factor only to the luminance component of the current picture frame in the YUV color space; and converting the modified luminance component and color components of the current picture frame back into an RGB color space for display in the liquid crystal cell;

thereby increasing the transition speed from one luminance level to another.

22. The system according to claim 21, said system being arranged in a scanning backlight system.

* * * * *